US007578316B2

(12) United States Patent
Gesing

(10) Patent No.: US 7,578,316 B2
(45) Date of Patent: Aug. 25, 2009

(54) HEDDLE SHAFT ROD, HEDDLE SHAFT, AND METHOD FOR PRODUCING A HEDDLE SHAFT ROD

(75) Inventor: Karl-Heinz Gesing, Raesfeld (DE)

(73) Assignee: Groz-Beckert KG, Albstadt (DE)

( * ) Notice: Subject to any disclaimer, the term of this patent is extended or adjusted under 35 U.S.C. 154(b) by 707 days.

(21) Appl. No.: 10/860,480

(22) Filed: Jun. 4, 2004

(65) Prior Publication Data

US 2004/0244862 A1 Dec. 9, 2004

(30) Foreign Application Priority Data

Jun. 5, 2003 (DE) ..... 103 25 908

(51) Int. Cl.
*D03C 9/06* (2006.01)

(52) U.S. Cl. ..... 139/91

(58) Field of Classification Search ..... 139/90–96
See application file for complete search history.

(56) References Cited

U.S. PATENT DOCUMENTS

| | | | | | |
|---|---|---|---|---|---|
| 3,948,296 | A | | 4/1976 | Koch | |
| 4,254,802 | A | * | 3/1981 | Kaufmann et al. | 139/91 |
| 4,390,045 | A | * | 6/1983 | Baumann | 139/91 |
| 4,484,604 | A | * | 11/1984 | Kramer et al. | 139/92 |
| 4,503,890 | A | * | 3/1985 | Kramer | 139/92 |
| 4,753,273 | A | * | 6/1988 | Gaisser | 139/91 |
| 4,901,767 | A | | 2/1990 | Koch | |
| 5,183,082 | A | | 2/1993 | Baumann | |
| 5,819,810 | A | * | 10/1998 | Kramer et al. | 139/91 |
| 6,076,250 | A | | 6/2000 | Spitzer | |
| 6,446,676 | B1 | * | 9/2002 | Magri et al. | 139/92 |

FOREIGN PATENT DOCUMENTS

| | | | |
|---|---|---|---|
| DE | 30 02 468 | A1 | 7/1981 |
| DE | 30 15 925 | A1 | 11/1981 |
| DE | 41 01 512 | C1 | 2/1992 |
| DE | 196 25 076 | A1 | 7/1997 |

* cited by examiner

*Primary Examiner*—Gary L. Welch
*Assistant Examiner*—Andrew W Sutton
(74) *Attorney, Agent, or Firm*—Norman N. Kunitz; Fitch, Even, Tabin & Flannery

(57) ABSTRACT

The heddle shaft rod (4) described originates in an extruded aluminum profile section with relatively thick side walls, which are removed in some regions and thereby made thinner. This can be done without substantial impairment to the rigidity of the heddle shaft rod, yet as a result a substantial reduction in weight is attained. The removal of material can be adapted to the local load conditions. For instance, it is possible at the ends or other force introduction points to leave unweakened thick walls, while the other regions of the side walls are milled off far enough that a uniform thinner wall thickness is attained. It is furthermore possible to vary the amount of material removed, either in multiple steps or in infinitely graduated fashion. The material removal pertains to a reduction in the wall thickness that is measured transversely to the movement direction of the heddle shaft rod. In addition, the profile section height of the heddle shaft rod can be varied, for instance by suitable milling off of the solid profile section region toward the ends, and this height is measured in the movement direction H.

17 Claims, 4 Drawing Sheets

HEDDLE SHAFT ROD, HEDDLE SHAFT, AND METHOD FOR PRODUCING A HEDDLE SHAFT ROD

CROSS REFERENCE TO RELATED APPLICATION

This application claims the priority of German Patent Application No. 103 25 908.2, filed on Jun. 5, 2003, the subject matter of which, in its entirety, is incorporated herein by reference.

BACKGROUND OF THE INVENTION

The invention relates to a heddle shaft rod and a heddle shaft as well to a method for producing a heddle shaft rod in which such a heddle shaft is contemplated, particularly for high-speed power looms.

In designing heddle shafts, the goal has long been to reduce their mass. German Patent DE 41 01 512 C2, for instance, discloses a heddle shaft rod for this purpose which has a support rod, embodied as a hollow body, that is adjoined by a supporting part for the heddle support rail. The support rod comprises two flat sheet-metal strips, essentially parallel to one another, which are joined at their upper longitudinal edges to a longitudinal rod of rectangular cross section. A molded sheet-metal part located on their lower longitudinal edges joins them and supports the heddle support rail. The thus-surrounded internal chamber is filled with filler bodies of honeycomb-like structure.

A disadvantage of a heddle shaft rod of this type is not only the accumulation of material at the points where the heddle shaft rod is connected to the support rail, with the attendant increase in weight, but also the more-complicated and more-expensive joining technology, for instance in the form of laser welding. In addition, the attainable strength depends definitively on the load-bearing capacity of the existing joining points.

From German Patent DE 196 25 076 C2, a heddle shaft rod for heddle shafts is known that is formed by a hollow metal profile section. The height of the hollow profile section is reduced toward its lateral ends by suitable postmachining. This reduces the total weight of the heddle shaft rod, but because of the great mass in the center of the heddle shaft rod, it does not increase the bending strength under dynamic stress. In addition, the chambers, which because of the post-machining are open at the ends, have to be closed with light-weight construction materials.

To join heddle shafts to the lateral supports, releasable corner connections are used, among other kinds. In heddle shafts of the kind proposed for instance in DE 41 01 512 C1 and DE 196 25 076 C2, these corner connections are reinforced as in German Patent DE 40 38 384 C2, in order to transmit forces from the lateral supports to the heddle shaft rods. This increases the mass of the total system, and the effect is to limit performance.

SUMMARY OF THE INVENTION

With this prior art as background, it is the object of the invention to create a heavy-duty heddle shaft rod which is easy and simple to produce. It is also the object of the invention to create a method with which such a heddle shaft rod can be produced.

These objects are attained according to a first aspect of the invention with a heddle shaft rod which is embodied or formed as a profile section body, preferably a metal profile section body; it has what in use are an upper and a lower short side, between which at least one side wall but preferably two side walls are located. The side wall has a varying wall thickness in the longitudinal direction of the heddle. For instance, in the regions near the ends, the wall thickness of the side wall is relatively great, while in the middle region between them it is reduced markedly. The reduction in the wall thickness of the side wall in the middle region does not definitively impair the bending strength of the heddle shaft rod. However, the weight is reduced substantially. In comparable heddle shaft rods with an unweakened side wall and with a weakened side wall, for the same weight, the latter have a greater bending strength. At the ends of the heddle shaft rod, however, the side wall is embodied as somewhat thicker. This provides sufficient opportunity to attach lateral supports in a simple, economical way, so that from two heddle shaft rods and at least two lateral supports, one heddle shaft can be produced. The thicker side wall in the end regions makes it easy to introduce the requisite forces into the heddle shaft rod.

The side wall is preferably embodied without interruptions, that is, without openings, breaches or the like, although these are not precluded. The heddle shaft rod is furthermore preferably embodied in one piece. Reducing the thickness of the side wall can be attained for instance in a milling operation, in which a part of the side wall that protrudes past the rest of the side face is milled off, or in a somewhat more-difficult method, a suitable indentation is milled into the otherwise flat side wall. The metal profile section is preferably an extruded aluminum profile section, which surrounds longitudinally extending hollow chambers. The extruded aluminum profile section initially has the same cross section throughout. Only as a result of the removal is the cross section partially altered.

In this concept, the heddle shaft rod can be produced in the forging tool department using relatively inexpensive pressing tools and relatively great wall thicknesses. Only after that are the side walls milled to become thinner than the forging tool departments would be capable of pressing the walls; as a result, the weight of the heddle shaft rod is reduced, yet its rigidity is preserved. At the ends of the heddle shaft rod, the walls are not milled off, however. As a result of this special cross-sectional construction, the heddle shaft rod ends become more stable.

Alternatively, it is possible to produce the profile section body that forms the heddle shaft rod with a thinner wall thickness, and to apply flat reinforcements to the side walls on the ends, for instance by adhesive bonding, in order to increase the wall thickness there. A wall thickness of the side walls that varies over the longitudinal direction can be attained in this way as well.

A solid profile section region, whose wall thickness is markedly greater than that of the rest of the profile section, is preferably embodied on the back of the heddle shaft rod. This solid profile section region can be made with a markedly increased cross section, and in particular an increased height, compared to a conventional heddle shaft rod. The increase in weight is compensated for by a milling operation that removes material, so that a heddle shaft rod weight is achieved which is equal to or less than that of a conventional heddle shaft rod. Strips of carbon fiber reinforced plastic or of steel can be incorporated into the solid profile section region to increase the rigidity. As a result of the increased rigidity of the heddle shaft rod, compared to non-optimized heddle shaft rods, its dynamic sagging is reduced, and as a result, problems associated with heddle breakage, heddle wear, skewing of heddles, and warp thread breaks can be markedly reduced. In relatively long heddle shafts, a center connector and center drive mechanisms can be dispensed with. The result is a reduction in cost. Handling is also improved, because changing heddles does not require any effort to install and remove center connectors.

The metal-cutting postmachining of an extruded aluminum profile section, particularly at its side walls, moreover has a favorable effect on the production quality. The increase in weight of extruded aluminum profile sections otherwise found, resulting from wear to the pressing tools, is for the most part eliminated by milling off the side walls.

One or more cross members are preferably embodied in the internal chamber of the aluminum hollow chamber profile section; they join the side walls to one another and prevent them from buckling outward under dynamic stresses. Instead of such cross members, however, it is also possible for the internal chamber located between the side walls to be filled either entirely or partially with foam, or to be filled with other lightweight components, such as honeycombs or the like.

Preferably, the side walls of the hollow chamber profile section are offset somewhat outward toward an upper solid profile section region, the offset being less than the wall thickness. Thus when this offset is completely milled off, plane faces are created on the sides, and the side walls are not breached. This has advantages from the production standpoint, because the solid profile section region can be used as a reference face.

Further details of advantageous embodiments of the invention will become apparent from the drawing, the description, or dependent claims.

Exemplary embodiments of the invention are illustrated in the drawing. Shown are:

DETAILED DESCRIPTION OF THE INVENTION

Figure 1:
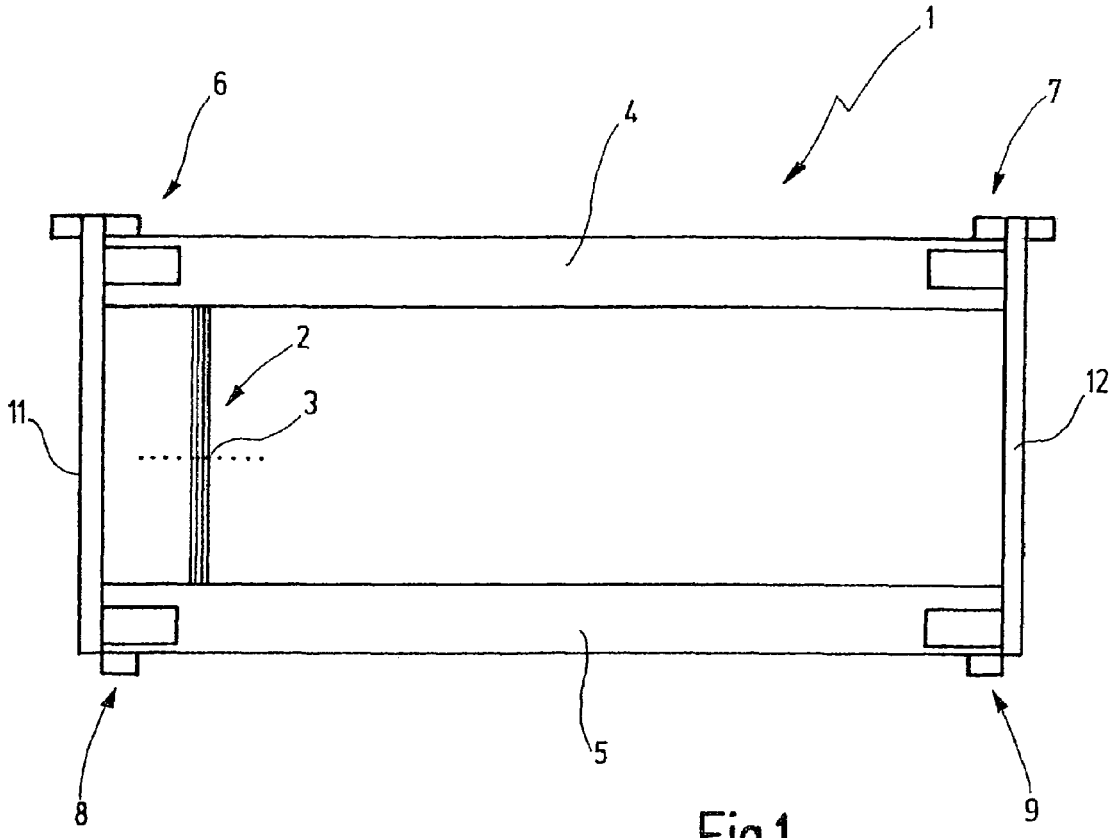
FIG. 1 is a schematic elevation view of a heddle shaft.

In FIG. 1, a heddle shaft 1 is shown which is intended for use in high-speed power looms. The heddle shaft 1 forms a rectangular frame in which heddles 2 are retained in relatively high number, parallel to one another. The heddles 2 each have one yarn eyelet 3, through which the warp thread of the loom passes. The heddle shaft 1 serves to move the warp threads upward and downward at the working pace of the loom, for forming sheds.

Figure 2:
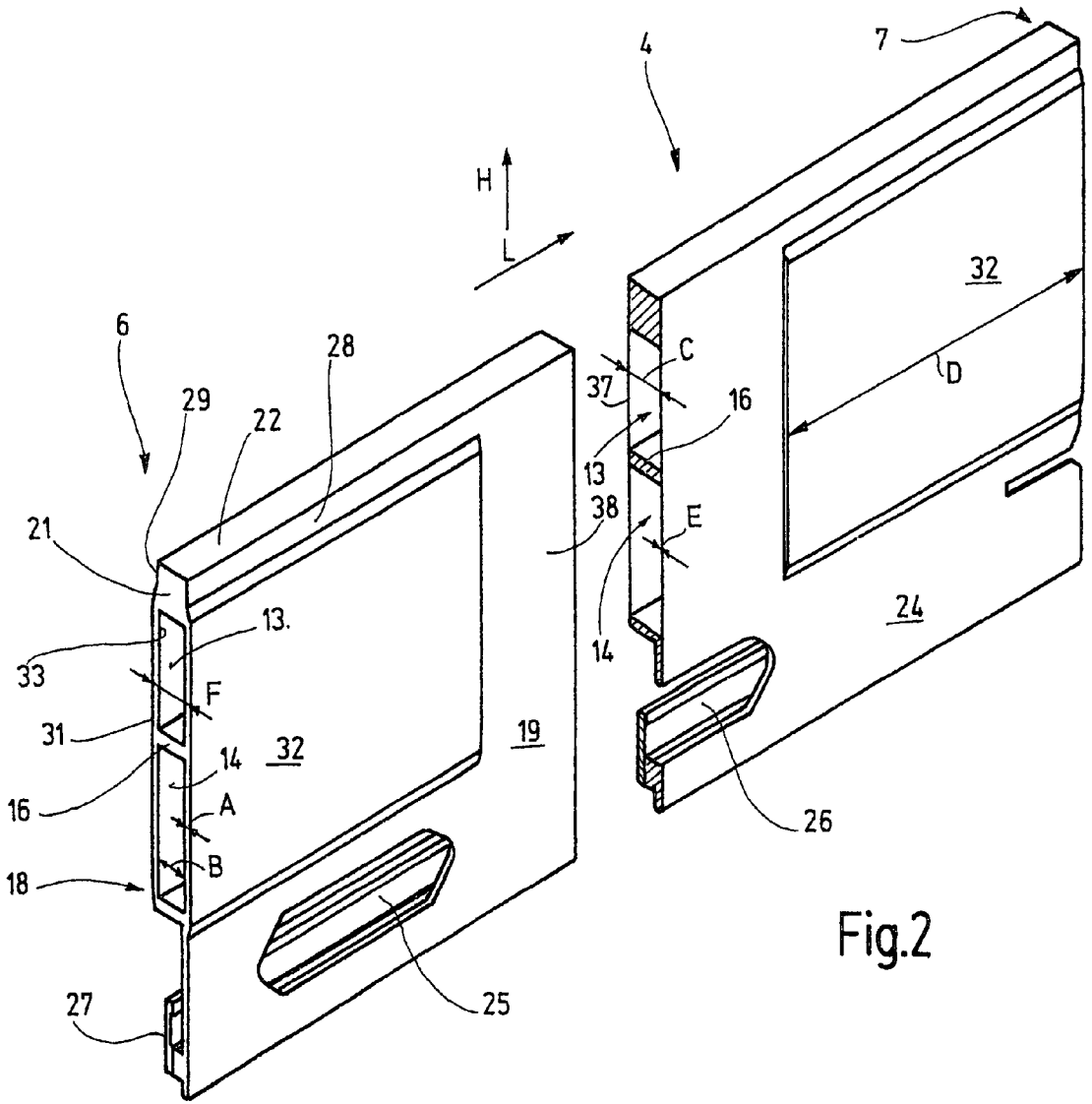
FIG. 2 is a perspective, greatly foreshortened view of a heddle shaft rod of the heddle shaft of FIG. 1.

The heddle shaft includes two heddle shaft rods 4, 5, which are spaced apart parallel from one another and are joined together at their respective ends 6, 7, 8, 9 by lateral supports 11, 12. The heddle shaft rods 4, 5 are embodied substantially identically to one another. In FIG. 2, the heddle shaft rod 4 is therefore shown, representing them both, and will be described in further detail below.

Figure 3:
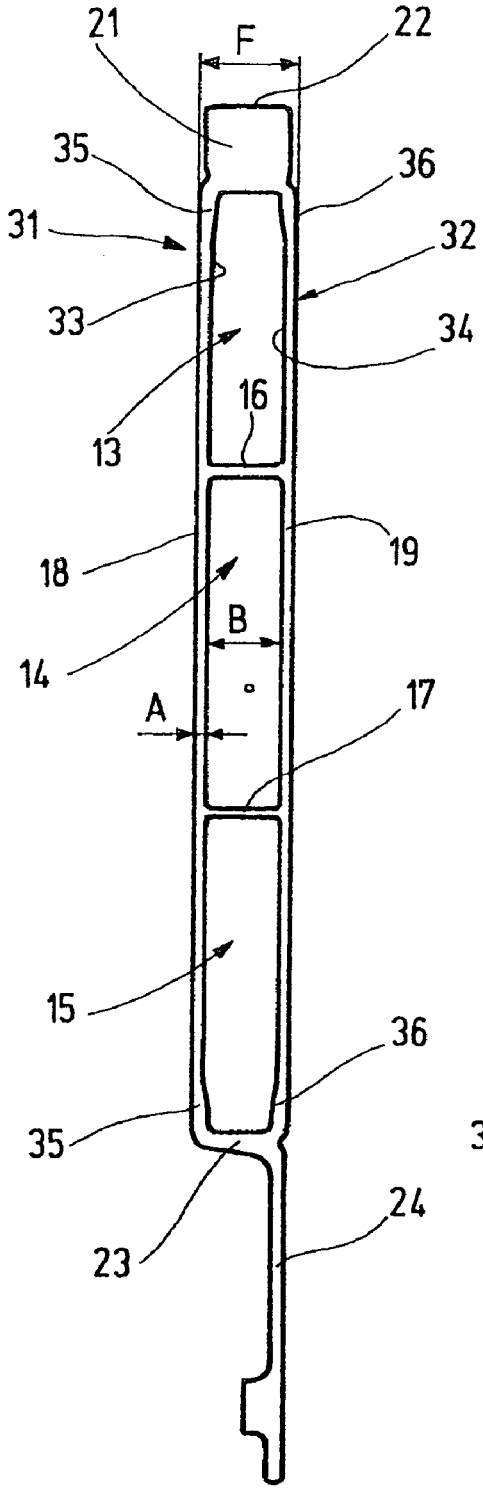
FIG. 3 shows according to the invention the heddle shaft rod of FIG. 2, in section in its end region.
Figure 4:
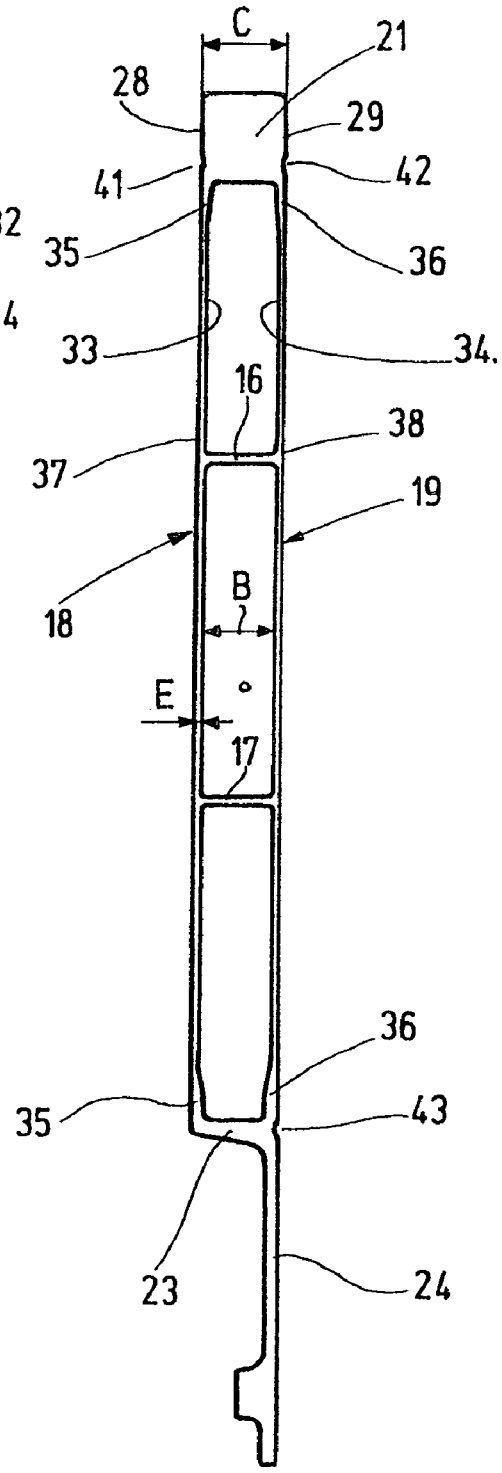
FIG. 4 shows the heddle shaft rod of FIG. 2, in section in a middle region.

The heddle shaft rod 4 is a one-piece aluminum body, whose basic shape has been produced by extrusion, for instance. In this way, a hollow chamber profile section is formed, having two longitudinally extending, approximately rectangular internal chambers 13, 14, or, as the slightly modified embodiments of FIGS. 3 and 4 show, having three internal chambers 13, 14, 15. Accordingly, one or more cross members 16, 17 are present, which are longitudinally continuous and separate the internal chambers 13, 14, 15 from one another and join side walls 18, 19 of the profile section body to one another. The wall thickness of the cross members 16, 17 is less than the thickness of the side wall 18, 19 and thus contributes to reducing the weight. The substantially flat side walls 18, 19 are face-parallel to one another and merge with a solid profile section region 21 that closes off the profile section at the top with a striplike, flat short side 22. On the side opposite the solid profile section region 21, the profile section is closed off by a wall 23 whose wall thickness is greater than the thickness of the cross members 16 or 17. Because of the increased wall thickness, the end of the profile section and thus the corner connection are reinforced. The wall 23 is adjoined by an extension 24, which as FIG. 2 shows may have one or more breached places 25, 26, i.e., openings, for reducing the weight. The extension 24 serves to secure a support rail 27, in which the heddles 2 are suspended and thus secured.

The profile section of the heddle shaft rod 4 is not uniform. On its end 6 and on its end 7, the side walls 18, 19 are offset outward, relative to striplike face regions 28, 29 of the side wall that adjoin the short side 22, so that surface protrusions 31, 32 defined by steps are embodied on both side walls 18, 19. These surface protrusions are flat plateaulike faces, where the thickness or wall thickness A (FIG. 2) of the side wall 19 and of the side wall 18 is relatively great. It may be in the range between 1 mm and 2 mm, for instance. Preferably, it is 1.3 mm. The width B of the internal chambers 13, 14, and also the width of the internal chamber 15 in the embodiments of FIGS. 3 and 4, is less than the width C that can be measured between the face regions 28, 29. The inner wall 33, 34, oriented parallel to the side wall 18, 19, is thus offset parallel inward relative to the respective face region 28, 29. The face regions 28, 29 are located in imaginary planes that extend through each side wall 18, 19 between the respective wall 33, 34 and the outside of each side wall. Particularly at the steps pointing toward one another, the surface protrusions 31, 32 are defined by straight steps extending parallel to one another, which are perpendicular to the longitudinal direction L. However, it is also possible for the steps to be oblique or tapered or curved. Instead of a step, a gradual transition in the wall thickness can also be provided.

The wall 33, 34 is not completely flat; instead, as can be seen from FIGS. 3 and 4, and this also applies to FIG. 2, by means of a rounded step 35, 36, it merges with the short side 22, 23. This step 35, 36 is S-shaped in this exemplary embodiment, but all other shapes of transition, such as elliptical transitions, are also possible. The cross member 16, 17, conversely, merges with the side walls 18, 19 without a step, but instead only with a rounded portion of identical or similar form. If needed, however, suitable steps may be provided here as well.

In the exemplary embodiment, each end region of the heddle shaft rod 4 has a length D of approximately 60 mm. This is true for both the end 6 and the end 7. The length of these end regions is defined as a function of the type of drive mechanisms that engage the end regions. For instance, it can also be 150 mm long. Between the two end regions, the surface protrusions 31, 32 are removed, for instance by milling. In the intermediate portion 37, 38 present here, the side walls 18, 19 are embodied as flat. By the removal of material from the two side walls 18, 19, a wall thickness E that is substantially less than the wall thickness A is obtained in the intermediate portion 37, 38. This can be seen by comparing the illustration on the right with the illustration on the left in FIG. 2. It can also be seen from a comparison of FIGS. 3 and 4. The wall thickness E is preferably less than 1 mm. It is preferably from 0.35 mm to 0.6 mm. After the superficial removal of the surface protrusions 31, 32, flat side walls 18, 19 with the aforementioned slight wall thickness remain. The face regions 28, 29 can serve as orientation and guide faces, so that excessive weakening of the side walls 18, 19 will not occur when large-area removal of the surface protrusions 31, 32 is done. An optimized profile section has a width C of 9 mm, for instance, and a width F (measured between the outsides of the surface protrusions 31, 32) of 10.5 mm, an inner width B of 7.9 mm, and a wall thickness E of 0.55 mm.

To facilitate the orientation in removal of the surface protrusions 31, 32, the surface protrusions can both be defined by grooves 41, 42, 43, extending in the longitudinal direction L (FIG. 2), which are shown in FIGS. 3 and 4. The grooves can furthermore be used to control the milling depth, in order to attain the desired wall thickness in a controlled fashion.

The surface protrusions 31, 32 are not milled off wherever forces are introduced into or carried out of the heddle shaft rods 4, 5. This applies to the ends and possibly the middle of the shaft, if drive elements or connecting rods are located there. There is no need for sheet-metal reinforcements for corner connectors at the ends 6, 7, 8, 9 of the heddle shaft rods. This prevents streakiness in the fabric. With the method of the invention, wall thicknesses A can be attained that can otherwise hardly be achieved in extrusion, or in any case not at reasonable expense.

The cross member 17 and/or the cross member 16 can in particular be removed at the ends 6, 7, 8, 9, in order to unite the internal chambers 13, 14, 15. The taller chamber thus created can serve to receive a corner connector.

It is possible, as needed, for the solid profile section region 21 to be milled off particularly toward the ends 6, 7, 8, 9, to reduce the weight of the heddle shaft rod 4 or 5 further, without impairing the rigidity of that heddle shaft rod. It is moreover possible, instead of the solid profile section region 21, to provide a U-shaped profile section region that has two legs extending away from the profile section in the vertical direction H (FIG. 2) in the extension of the side walls 18, 19. These legs can likewise be milled off decreasingly toward the ends 6, 7, 8, 9.

Offsetting the side walls 18, 19 outward not only enables subsequent milling in order to reduce the thickness of the side walls; it also increases the volume, particularly of the internal chambers 13, 14, 15 (FIGS. 3 and 4). As a result, corner connectors can be embodied more stably than in comparable profile sections without side walls that are offset outward.

Figure 5:
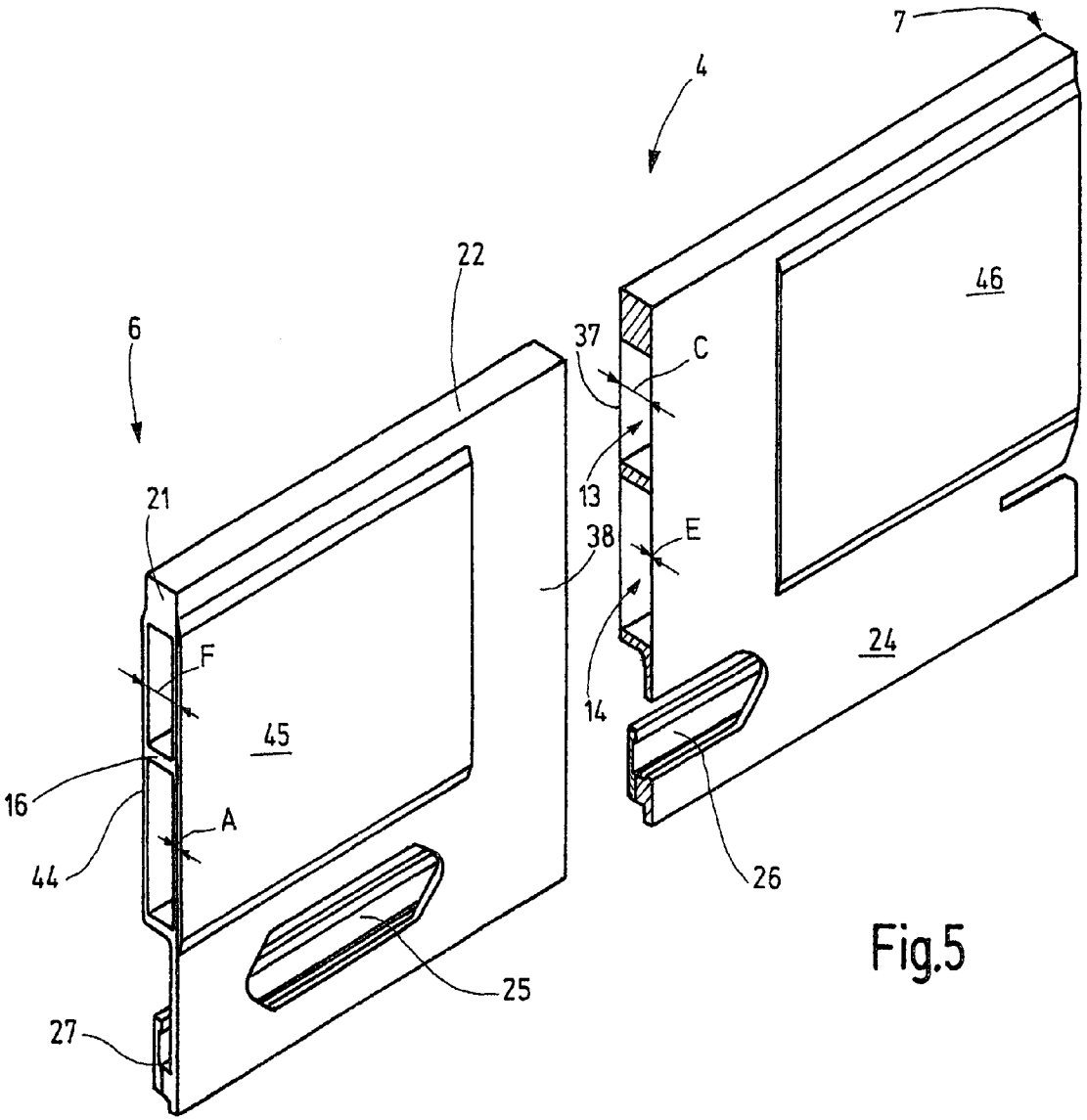
FIG. 5 is a perspective, greatly foreshortened view of a modified embodiment of the heddle shaft rod according to the invention.

FIG. 5 illustrates a modified, for which the above description applies, assuming the same reference numerals. In a distinction from the heddle shaft rod 4 or 5 of the above description, the extruded aluminum profile section of the heddle shaft rod 4, however, has been milled off continuously over its full length. The increase in the wall thickness of the side walls 18, 19 in the end regions adjoining the ends 6, 7 has been attained by superficial adhesive bonding of sheet-metal reinforcements 44, 45, 46. In this way, the same conditions as in the heddle shaft 4 described above, in which the end regions were recessed by the milling operation of the side walls 18, 19, are attained.

Adhesively bonding sheet-metal reinforcements is, however, also possible in a heddle shaft rod of the kind shown in FIG. 2, FIG. 3, or FIG. 4, for instance if a reinforcement is again necessary afterward in a middle region or in some other region that has been milled off.

The heddle shaft rod 4 described originates in an extruded aluminum profile section with relatively thick side walls, which are removed in some regions and thereby made thinner. This can be done without substantial impairment to the rigidity of the heddle shaft rod, yet as a result a substantial reduction in weight is attained. The removal of material can be adapted to the local load conditions. For instance, it is possible at the ends or other force introduction points to leave unweakened thick walls, while the other regions of the side walls are milled off far enough that a uniform thinner wall thickness is attained. It is furthermore possible to vary the amount of material removed, either in multiple steps or in infinitely graduated fashion. The material removal pertains to a reduction in the wall thickness that is measured transversely to the movement direction of the heddle shaft rod. In addition, the profile section height of the heddle shaft rod can be varied, for instance by suitable milling off of the solid profile section region toward the ends 6, 7, and this height is measured in the movement direction H.

LIST OF REFERENCE NUMERALS

1 Heddle shaft
2 Heddles
3 Yarn eyelet
4, 5 Heddle shaft rods
6, 7, 8, 9 Ends
11, 12 Lateral supports
13, 14, 15 Internal chambers
16, 17 Cross members
18, 19 side walls
21 Solid profile section region
22 Short side
23 Wall or short side
24 Extension
25, 26 Openings
27 Support rail
28, 29 Face regions
31, 32 Surface protrusions
33, 34 Wall
35, 36 Step
37, 38 Intermediate portion
41, 42, 43 Grooves
44, 45, 46 Sheet-metal reinforcements
A Thickness (wall thickness
B, C, F Width
D Length
E Wall thickness
H Movement direction
L Longitudinal direction

The invention claimed is:

1. A heddle shaft rod, in particular for heddle shafts of high-speed power looms, comprising:

a hollow chamber profile section body that is formed in one piece and has two short sides and at least one side wall formed between the two short sides, with the at least one side wall, in at least two regions spaced apart from one another in the longitudinal direction of the shaft rod, having greater wall thicknesses; and wherein a solid profile section region whose wall thickness is markedly greater than that of the rest of the profile section is embodied adjoining one short side of the heddle shaft rod and extending alone the length thereof; and the at least two regions of the side wall having greater wall thicknesses project laterally beyond an outer side face of said solid profile section region.

2. The heddle shaft rod of claim 1, wherein the side wall is embodied without interruptions.

3. The heddle shaft rod of claim 1, wherein the profile section body is an extruded aluminum profile section.

4. The heddle shaft rod of claim 1, wherein on regions near the longitudinal ends of the body, the wall thickness is greater than the wall thickness in regions that are located between the regions near the longitudinal ends.

5. The heddle shaft rod of claim 1, wherein the different wall thicknesses were created by removal of material from an outer face of the body side wall.

6. The heddle shaft rod of claim 1, wherein the solid profile section region is approximately square.

7. The heddle shaft rod of claim 5, wherein longitudinal grooves, which divide milling regions from which material has been removed, from non-milling regions, are embodied on the outsides of the side walls.

8. A heddle shaft, in particular for high-speed power looms, having a heddle shaft rod of claim 1.

9. The heddle shaft rod of claim 1, wherein the two spaced regions have a larger wall thickness than a region of the side wall between the two adjacent spaced regions, and a respective one of said larger wall thickness regions is disposed at each longitudinal end of the shaft rod.

10. A heddle shaft rod, in particular for heddle shafts of high-speed power looms, comprising: a hollow chamber profile section body that is formed in one piece of the same material and has two short sides and two side walls formed between the two short sides, with at least one side wall, in at least two regions spaced apart from one another in the longitudinal direction of the shaft rod, having different wall thicknesses; and wherein at least one cross member, which joins the side walls to one another, is embodied in the internal chamber surrounded by the hollow chamber profile section; and the profile section body, in a portion extending along at least one of its short sides, has a partial region with a minimum width, measured between its outer side faces, that is greater than the maximum inner width of the hollow chamber profile section and the at least two spaced regions of the at least one side wall project laterally beyond the outer side face of the partial region and have greater wall thicknesses than regions of the at least one side wall between the two spaced regions.

11. The heddle shaft rod of claim 10, wherein a plurality of cross members which are located at equal intervals from one another and from the short sides of the hollow chamber profile section are embodied in the internal chamber.

12. The heddle shaft rod of claim 10, wherein the cross members, with rounded portions, merge with the side walls.

13. The heddle shaft rod of claim 9, wherein the inner face of the at least one sidewall is substantially flat, and the larger wall thickness is caused by outwardly directed protrusions on an outer face of the sidewall.

14. The heddle shaft rod of claim 9, wherein the inner face of the at least one sidewall is substantially flat, and the larger wall thickness is caused by pieces of metal fastened to an outer face of the sidewall.

15. The huddle shaft rod of claim 10, wherein the partial region is a solid profile section region.

16. The heddle shaft rod of claim 15, wherein the solid profile section region is substantially square.

17. A heddle shaft rod, in particular for heddle shafts of high-speed power looms, comprising: a hollow chamber profile section body having two short sides and two side walls extending between the two short sides, with at least one side wall, in at least two regions spaced apart from one another in the longitudinal direction of the shaft rod, having different wall thicknesses; and, wherein the profile section body, in a region extending along at least one of its short sides, has a minimum width, to be measured between its side faces, that is greater than the maximum inner clearance width of the hollow chamber profile section between the two side walls, and surface protrusions that define a width of the profile section body greater than the minimum width are embodied on the outer side faces of the at least one side wall to produce the different wall thicknesses.

* * * * *